US007477752B2

(12) United States Patent
Kirk

(10) Patent No.: US 7,477,752 B2
(45) Date of Patent: Jan. 13, 2009

(54) LOUDSPEAKER SYSTEM

(75) Inventor: Edgar Kirk, Vaterstetten (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 982 days.

(21) Appl. No.: 10/978,004

(22) Filed: Nov. 1, 2004

(65) Prior Publication Data

US 2005/0069150 A1 Mar. 31, 2005

Related U.S. Application Data

(63) Continuation of application No. PCT/EP03/02213, filed on Mar. 5, 2003.

(30) Foreign Application Priority Data

May 2, 2002 (DE) ..... 102 19 657

(51) Int. Cl.
*H04R 1/40* (2006.01)

(52) U.S. Cl. ..... 381/97; 381/28; 381/89; 381/120

(58) Field of Classification Search ..... 381/98–99, 381/109, 89, 120, 97, 28; 330/252, 258
See application file for complete search history.

(56) References Cited

U.S. PATENT DOCUMENTS 3,818,136 A * 6/1974 Schott ..... 381/21
4,528,686 A * 7/1985 Dressler ..... 381/28
4,897,877 A 1/1990 Tetzlaff
5,586,194 A 12/1996 Risch (Continued)

FOREIGN PATENT DOCUMENTS

DE 17 91 245 U 7/1959

(Continued)

*Primary Examiner*—Vivian Chin
*Assistant Examiner*—Disler Paul
(74) *Attorney, Agent, or Firm*—Crowell & Moring LLP

(57) ABSTRACT

A loudspeaker system with three loudspeakers (LF, LR, LB), includes a first and a second amplifier (BF, BR), each of which amplifies a channel of an audio signal. The outputs of the amplifiers (FDA, FIA; RDA, RIA) are in phase opposition, wherein the outputs of the amplifiers (RDA, FIA; RDA, FIA) are each connected to the inputs of the first and second loudspeakers (LF, LR). The outputs of the amplifiers (RDA, FIA; RDA, FIA) are also connected to the inputs of the third loudspeaker (LB). A high-pass filter (HP) and a low-pass filter (TP), which are used to partition the audio signal, are connected in parallel. As the amplifiers, bridge output stages (BF, BR) are provided. The output of the high-pass filter (HPA) is connected to the inputs of the two bridge output stages (BF, BR). An inverter (IF, IR) is provided in each case between the output of the high-pass filter (HPA) and one of the inputs of the bridge output stages (BF, BR). In front of each of the inputs of the bridge output stages (BF, BR), summators (SF, SR) are connected, and the output of the low-pass filter is connected to the inputs of the summators (SF, SR). With one bridge output stage (BR), an inverter (IB) is provided between the output of the low-pass filter (TP) and the inputs of the summators (SR). The third loudspeaker (LB) is connected to two opposite-phase outputs of the two bridge output stages (BF, BR).

18 Claims, 2 Drawing Sheets

U.S. PATENT DOCUMENTS

| | | | | |
|---|---|---|---|---|
| 5,856,759 | A | 1/1999 | Krochmal | |
| 5,875,250 | A | 2/1999 | Kuo et al. | |
| 6,181,796 | B1 * | 1/2001 | Johnson | 381/28 |
| 6,529,787 | B2 * | 3/2003 | Weikel et al. | 700/94 |
| 2001/0018621 | A1 | 8/2001 | Weikel et al. | |
| 2001/0028723 | A1 | 10/2001 | Yang et al. | |

FOREIGN PATENT DOCUMENTS

| | | | |
|---|---|---|---|
| DE | 34 16 494 | A1 | 11/1985 |

* cited by examiner

LOUDSPEAKER SYSTEM

CROSS-REFERENCE TO RELATED APPLICATIONS

This application is a CONTINUATION of PCT Application No. PCT/EP03/02213, filed on Mar. 5, 2003, which claims priority of German Application No. 102 19 657.5, filed 2 May 2002, the disclosure of which is expressly incorporated by reference herein.

The invention relates to a loudspeaker system having three or more loudspeakers.

Ordinarily, for each loudspeaker employed in a motor vehicle, a separate output stage is used. This is associated with cost and required space. Furthermore, the efficiency of the entire arrangement is unfavorable. For example, German Patent Document DE 41 06 267 A1 describes the use of bridge output stages, the two outputs of which are in phase opposition, for expanding loudspeaker output. They thereby enable twice the voltage swing of a single output stage, with a given supply voltage.

From US 2001/0018621 A1, a multimedia-computer-loudspeaker system comprising a left and a right broadband loudspeaker and a bass loudspeaker is known, in which for each of the two broadband loudspeakers one amplifier is provided. One amplifier inverts and is connected to the terminals of the broadband loudspeaker assigned to it, inverted relative to the other amplifier/broadband loudspeaker pair. Each of the broadband loudspeakers is grounded via a terminal. The bass loudspeaker is parallel connected in series to the two amplifiers via a low-pass filter. The configuration is such that the bass loudspeaker receives more amplifier output than the broadband loudspeakers, making a separate amplifier for the bass loudspeaker unnecessary.

With this known loudspeaker system, the level of the bass loudspeaker can thus be adjusted only passively, for example via a resistor. A high-/low-pass control can also be performed only passively. Adjustments to the two equalizers or to the potentiometer in each case affect one of the broadband loudspeakers and the bass loudspeaker. Only one level adjuster for the left and right audio channel is provided via the connected potentiometers (balance control). If, for example, one of the broadband loudspeakers were to be switched off, the bass loudspeaker would receive only half the output and would no longer function satisfactorily.

The amplifier arrangements of known loudspeaker systems must, in practical terms, be doubled when additional loudspeakers are to be built into the system, e.g. the loudspeakers are to be arranged in pairs (in the front and rear of the vehicle). For, in practical usage, in addition to the demand for a cost-effective and high-performance loudspeaker system, there are also user requirements. If, for example, in the paired arrangement of loudspeakers, one of the loudspeaker pairs is to be switched off, or if its level is to be adjusted while the level of the other loudspeaker pair is retained, this type of separate control, e.g. with the system pursuant to US 2001/0018621 A1, cannot be implemented, as a separate level control independent of the bass loudspeaker is not possible.

The object of the invention is to create a loudspeaker system in which a separate control of the bass loudspeaker and the other loudspeakers, and an independent level control of individual loudspeakers is possible.

This object is attained according to the invention with a loudspeaker system with three loudspeakers (LF, LR, LB), comprising a first and a second amplifier (BF, BR), each of which amplifies a channel of an audio signal; wherein the outputs of the amplifiers (FDA, FIA; RDA, RIA) are in phase opposition; wherein the outputs of the amplifiers (RDA, RIA; RDA, FIA) are connected to the inputs of the first and second loudspeakers (LF, LR), respectively; wherein the outputs of the amplifiers (RDA, FIA; RDA, FIA) are also connected to the inputs of the third loudspeaker (LB); wherein bridge output stages (BF, BR) are provided as the amplifiers; wherein a device (HP, TP) for partitioning the audio signal into at least two parallel channels is connected to the inputs of both bridge output stages (BF, BR); wherein an inverter (IF, IR) is provided between the output of the device (HPA) to the at least one first channel and in each case one of the outputs of the bridge output stages (BF, BR); wherein summators are connected in front of each of the inputs to the bridge output stages (BF, BR) and the output of the device (TP) to a second channel is connected to the inputs of the summators (SF, SR); wherein with one bridge output stage (BR) an inverter (IB) is provided between the output of the device (TP) to the second channel and the inputs of the summators (SR); and wherein the third loudspeaker (LB) is connected to two opposite-phase outputs of the two bridge output stages (BF, BR). Advantageous further improvements on the loudspeaker system specified in the invention are described and claimed herein.

The loudspeaker system according to the invention is advantageously characterized in that in an arrangement comprising two bridge output stages, in addition to the existing differential signal, each output stage is also modulated with a common-mode signal. The common-mode signal of one output stage is in phase opposition to the common-mode signal of the other output stage. This makes it possible to control a third loudspeaker (usually the bass loudspeaker) using an independent signal, thereby also enabling an active level control.

The users of a vehicle can thus turn off a loudspeaker branch (front/rear) (so-called fading). However, the bass loudspeaker can still be fully controlled.

With this system design, because of the decrease in the number of components (output stage or external frequency), costs can be reduced. With three bridge output stages, comprised of four output stages, it is possible to control three loudspeakers.

Further, with a given number of output stages, a functional optimization is achieved due to the independent controllability of the loudspeakers. In addition to the separate level control, the frequency band can also be adjusted individually for the loudspeakers (in pairs). In this, a frequency filter can be installed in front of the output stage, i.e. in the low-level signal range, for which less costly components can be used. This further results in the possibility of active control, and thereby improved system protection.

To partition the audio signal, it is useful to employ a filter, wherein in one advantageous exemplary embodiment of the invention a high-pass and low-pass arrangement is used. Alternatively, a broadband signal may also be emitted at both bridge output stages. This is possible using either analog filter technology or digital signal processing.

One favorable embodiment of the loudspeaker system specified in the invention with symmetrical capacity utilization of the output stages, which otherwise are utilized in only one branch, is produced when a double-coil loudspeaker is used as the bass loudspeaker. The coil terminals can then be positioned in any arrangement at the outputs of the two bridge output stages, provided each coil is connected in phase opposition.

Other objects, advantages and novel features of the present invention will become apparent from the following detailed description of the invention when considered in conjunction with the accompanying drawings.

DETAILED DESCRIPTION OF THE DRAWINGS

Figure 1:
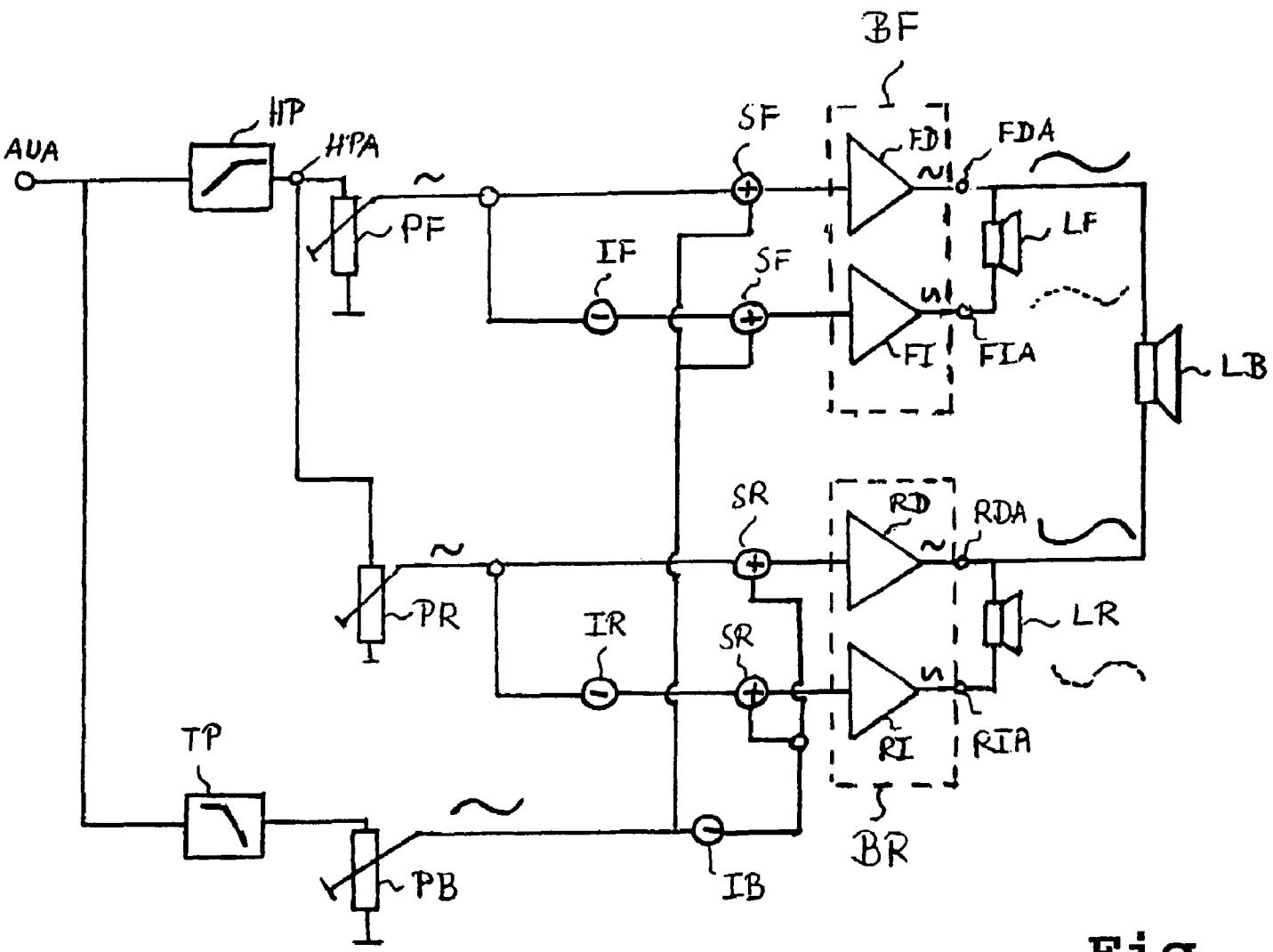
FIG. 1 is a schematic diagram of a loudspeaker system pursuant to a first exemplary embodiment of the invention.

FIG. 1 shows a schematic diagram for a loudspeaker system, which is designed for use in a motor vehicle having three loudspeakers LF (front), LR (rear) and LB (bass).

A high-pass filter HP and a low-pass filter TP are connected in parallel to an audio output AUA. Two level adjusters PF and PR, designed as potentiometers, are connected in parallel to the output of the high-pass filter HPA. The output of the potentiometer PF is fed directly to the input of a first output stage FD and, via an inverter IF, to the inverting input of a second output stage FI. The output stage FD and the output stage FI together form a bridge output stage BF, which is represented in FIG. 1 by a dashed line. The front loudspeaker LF is connected to the opposite-phase outputs FDA and FIA of the two output stages FD and FI, i.e. to the bridge output stage BF.

The output of the potentiometer PR is fed directly to the input of a third output stage RD and, via an inverter IR, to the inverting input of a fourth output stage RI. The output stage RD and the output stage RI together form a bridge output stage BR, which in FIG. 1 is represented by a dashed line. The rear loudspeaker LR is connected to the opposite-phase outputs RDA and RIA of the two output stage RD and RI, i.e. to the bridge output stage BR.

The level controller PB, also designed as a potentiometer, is connected to the output of the low-pass filter TP. Its output is connected via two summators SF, SF to the common-mode inputs of the bridge output stage BF, respectively. The common-mode signal applied in this manner is thus modulated, along with the existing differential signal, to the bridge output stage BF, but does not cause any amplification in the loudspeaker LF, which is amplified by the differential signal.

The output of the potentiometer PB is fed, parallel to the summators SF, SF, to an inverter IB, and via this, along with two summators SR, SR, is connected to each of the common-mode inputs of the bridge output stage BR. The common-mode signal applied in this manner is modulated to the bridge output stage BR, but does not affect the functioning of the loudspeaker LR.

Thus, opposite-phase common-mode signals are present at the output of the two bridge output stage BF and BR. In the exemplary embodiment represented here, a third bass loudspeaker LB is connected to the output terminals FDA and RDA of the two bridge output stages. For these, the two bridge output stages BF and BR again represent a bridge output stage with respect to the common-mode signal.

Figure 2:
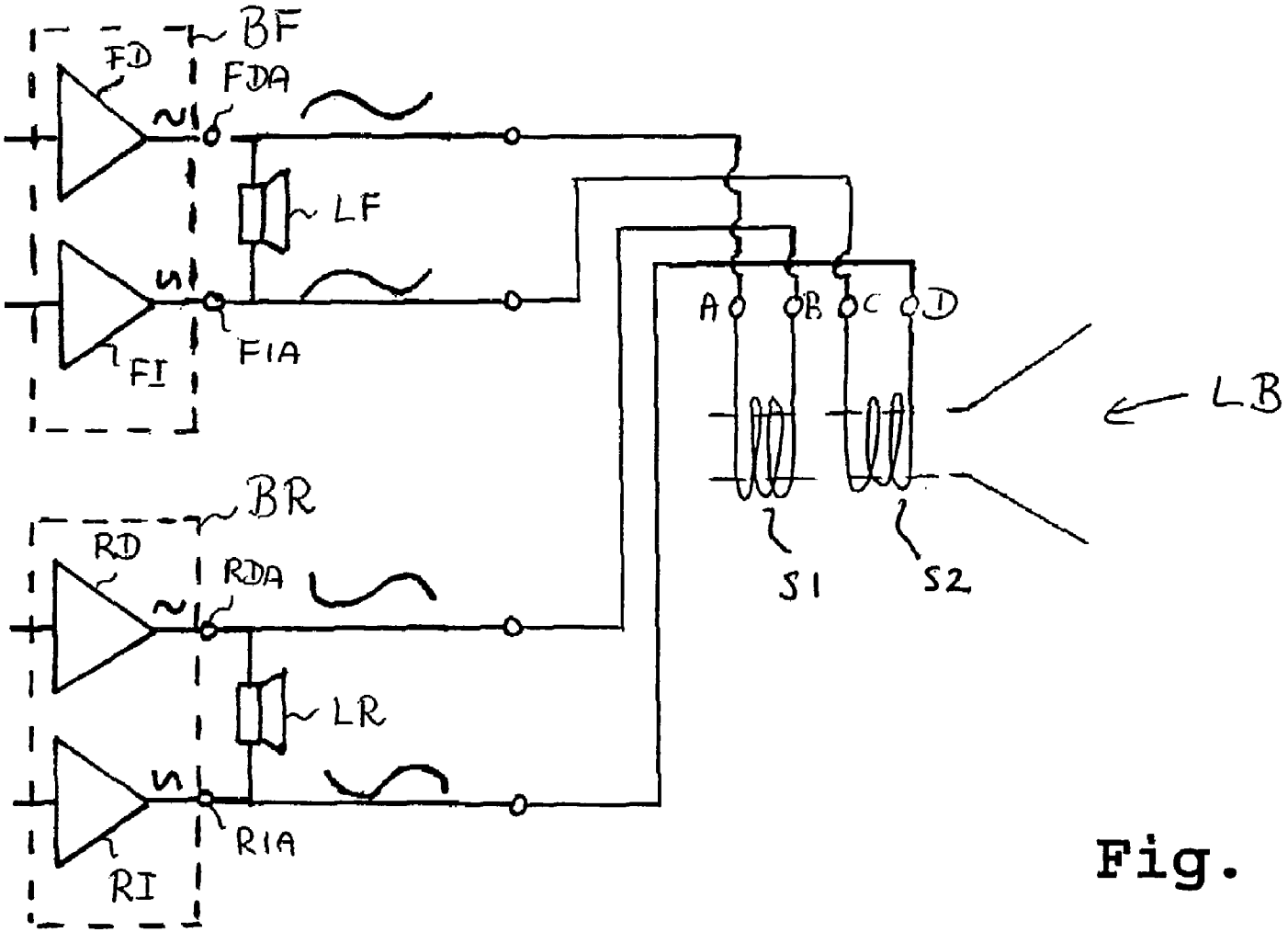
FIG. 2 is an excerpt of a schematic diagram of a loudspeaker system pursuant to a second exemplary embodiment of the invention.

FIG. 2 shows a second exemplary embodiment of a loudspeaker system as specified in the invention. This system differs from the previously described exemplary embodiment only in the design of the bass loudspeaker LB and its connection to the two bridge output stages BF, BR. For that reason, only a portion of the flow chart is shown.

The loudspeaker LB in this exemplary embodiment is a double-coil loudspeaker with two oscillator coils S1 and S2, which are electrically independent. In each case one terminal A, B and one terminal C, D of the two oscillator coils is connected to a bridge output stage BF, BR, respectively, so that all output stages of the bridge output stages BF, BR are utilized. In the exemplary embodiment shown, the terminals of the two bridge output stages and the two oscillator coils are connected to one another as follows: FDA-A, FIA-C, RDA-B, RIA-D. The result is a symmetrical capacity utilization of the output stages FD, FI, RD, RI. The loudspeaker LB can thus operate with the maximum output of the system.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Loudspeaker system with three loudspeakers, comprising:

a first and a second amplifier, each of which amplifies one channel of an audio signal, wherein outputs of the amplifiers are in phase opposition, the outputs of the amplifiers being connected to inputs of the first and second loudspeakers, respectively, wherein the outputs of the amplifiers are also connected to the inputs of the third loudspeaker; said amplifiers being configured as bridge output stages (BF, BR);

a device for partitioning the audio signal into at least two parallel channels is connected to inputs of both bridge output stages, wherein an inverter is provided between the output of a first part of the device for a first channel and, in each case, one of the inputs of the bridge output stages, wherein summators are connected in front of each of the inputs to the bridge output stages, and the output of a second part of the device for a second channel is connected to inputs of the summators, wherein for one bridge output stage, a further inverter is provided between the output of the second device of the second channel and inputs of the summators for the one bridge output stage, and wherein the third loudspeaker is connected to two opposite-phase outputs of the two bridge output stages.

2. Loudspeaker system according to claim 1, wherein the device for partitioning the audio signal is a filter.

3. Loudspeaker system according to claim 1, wherein the device for partitioning the audio signal comprises a high-pass filter as the first part and a low-pass filter as the second part, which are connected in parallel for partitioning the audio signal, wherein the output of the high-pass filter leads to the at least one first channel, and wherein the output of the low-pass filter leads to the at least second channel.

4. Loudspeaker system according to claim 2, wherein the device for partitioning the audio signal comprises a high-pass filter as the first part and a low-pass filter as the second part, which are connected in parallel for partitioning the audio signal, wherein the output of the high-pass filter leads to the at least one first channel, and wherein the output of the low-pass filter leads to the at least second channel.

5. Loudspeaker system according to claim 3, wherein the output of the high-pass filter is connected, via a level controller, to the inputs of the bridge output stages, respectively.

6. Loudspeaker system according to claim 4, wherein the output of the high-pass filter is connected, via a level controller, to the inputs of the bridge output stages, respectively.

7. Loudspeaker system according to claim 3, wherein the output of the low-pass filter is connected, via a level controller, to the inputs of the bridge output stages.

8. Loudspeaker system according to claim 4, wherein the output of the low-pass filter is connected, via a level controller, to the inputs of the bridge output stages.

9. Loudspeaker system according to claim 1, wherein the third loudspeaker is a bass loudspeaker.

10. Loudspeaker system according to claim 2, wherein the third loudspeaker is a bass loudspeaker.

11. Loudspeaker system according to claim 3, wherein the third loudspeaker is a bass loudspeaker.

12. Loudspeaker system according to claim 5, wherein the third loudspeaker is a bass loudspeaker.

13. Loudspeaker system according to claim 7, wherein the third loudspeaker is a bass loudspeaker.

14. Loudspeaker system according to claim 1, wherein the third loudspeaker comprises two separate, electrically independent oscillator coils, whose terminals are each connected to the outputs of the two bridge output stages.

15. Loudspeaker system according to claim 9, wherein the third loudspeaker comprises two separate, electrically independent oscillator coils, whose terminals are each connected to the outputs of the two bridge output stages.

16. A circuit for driving a three loudspeaker system, comprising:

a first and a second bridge output stage, each of which amplifies one channel of an audio signal, wherein outputs of the first and second bridge output stages are in phase opposition and are couplable to respective inputs of a first and a second loudspeaker, the outputs of the first and second bridge output stages being also couplable to inputs of a third loudspeaker of the three loudspeaker system;

a high-pass filter and a low-pass filter, which split the audio signal, are coupled in parallel, a high-pass filter output being coupled to inputs of the first and second bridge output stages;

an inverter disposed between the high-pass filter output and one respective input of the first and second bridge output stages;

summing units coupled upstream from the inputs of the first and second bridge output stages, a low-pass filter output being coupled to inputs of the summing units;

a further inverter disposed at one of the first and second bridge output stages between the low-pass filter output and the inputs of the summing units; and wherein the third loudspeaker is couplable to two outputs of the first and second bridge output stages which are in phase opposition.

17. The circuit according to claim 16, further comprising a level controller coupled between the high-pass filter output and the inputs of the first and second bridge output stages, respectively.

18. The circuit according to claim 17, further comprising a further level controller coupled between the low-pass filter output and the inputs of the first and second bridge output stages.

* * * * *